United States Patent [19]

Shaw

[11] 4,124,903

[45] Nov. 14, 1978

[54] SAFETY GARMENT FOR AUTOMOBILE REPAIRS

[76] Inventor: Ted G. Shaw, 1201 Hillside Rd., Northbrook, Ill. 60015

[21] Appl. No.: 819,500

[22] Filed: Jul. 27, 1977

[51] Int. Cl.[2] ..... A41D 13/02

[52] U.S. Cl. ..... 2/79; 2/82; 2/84

[58] Field of Search ..... 2/79, 84, 1, 80, 82

[56] References Cited

U.S. PATENT DOCUMENTS

| | | | |
|---|---|---|---|
| 1,426,540 | 8/1922 | Bernstein | 2/79 |
| 2,686,308 | 8/1954 | Courtois | 2/1 |
| 3,047,875 | 8/1962 | Patterson | 2/1 |
| 3,909,849 | 10/1975 | Botha | 2/79 |
| 4,023,223 | 5/1977 | Anderson et al. | 2/79 X |
| 4,038,698 | 8/1977 | Smith | 2/79 |

OTHER PUBLICATIONS

"Velcro" Product News, Jul. 19, 1976.

*Primary Examiner*—H. Hampton Hunter
*Attorney, Agent, or Firm*—Kegan, Kegan & Berkman

[57] ABSTRACT

A one-peice garment adapted to cover the clothing of a wearer during emergency automobile repairs on the highway, and in other situations where a high degree of wearer visibility is desirable. The fabric of the garment is impregnated with a luminescent orange dye and is thin enough to permit compact storage of the garment in a tool chest prior to use.

2 Claims, 3 Drawing Figures

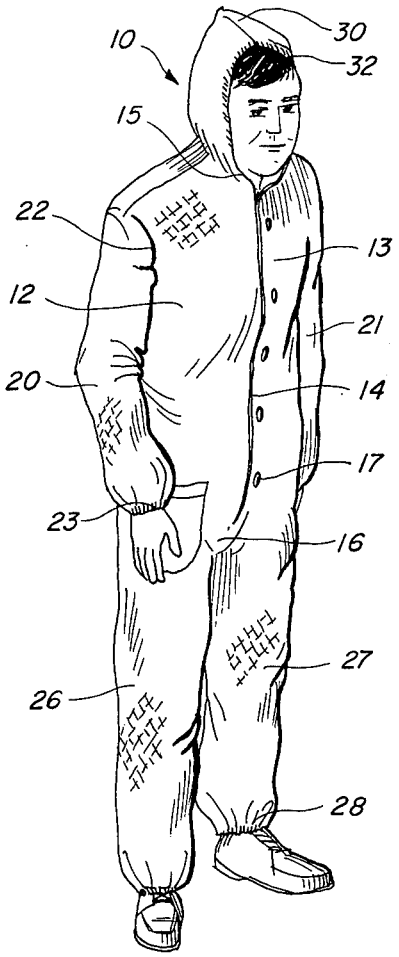
FIG. 1
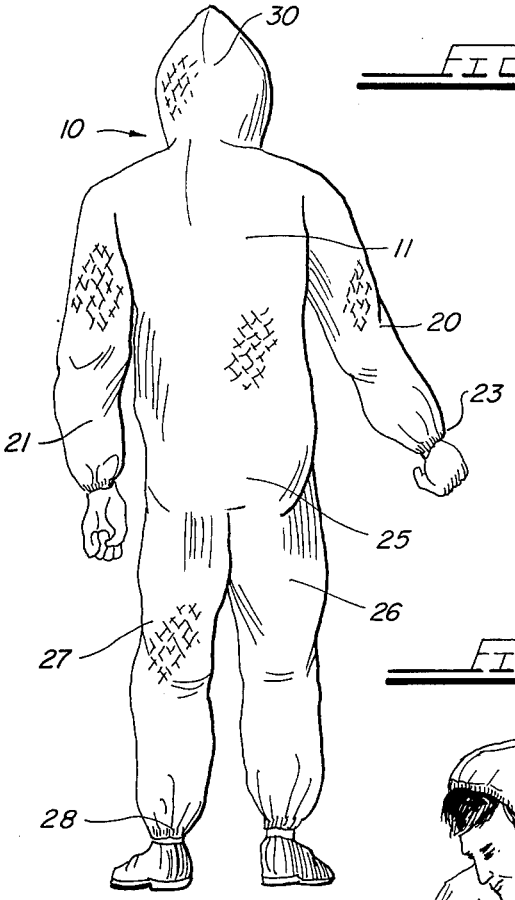
FIG. 2
FIG. 3
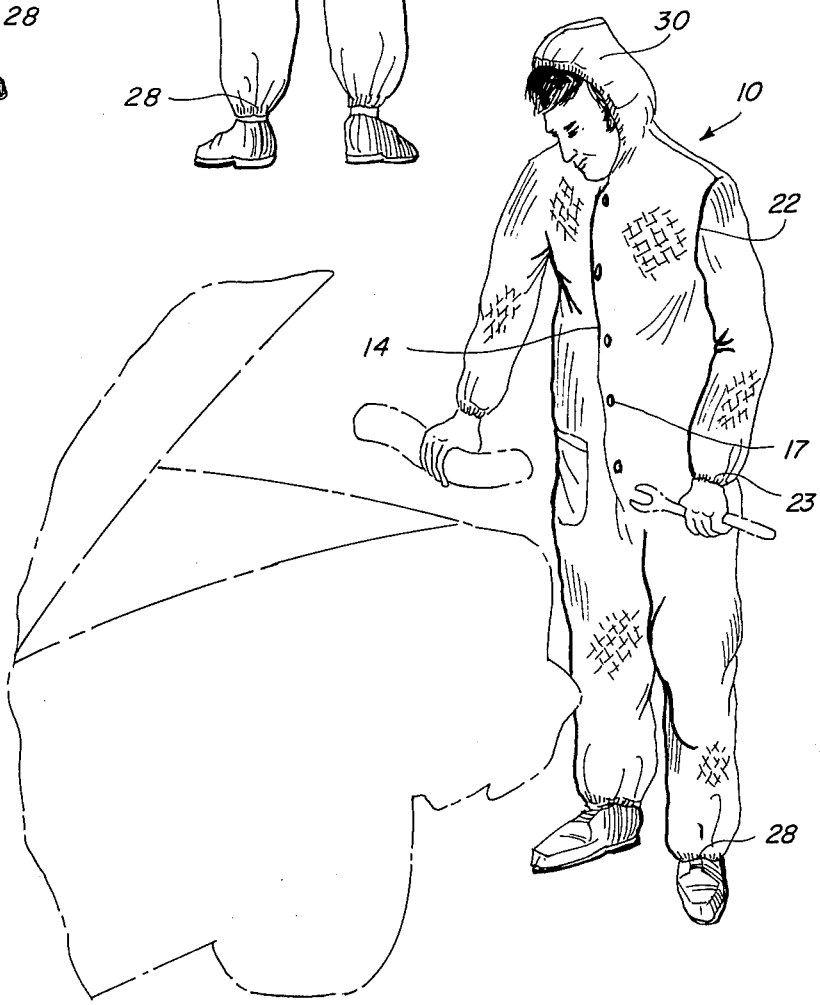

SAFETY GARMENT FOR AUTOMOBILE REPAIRS

BACKGROUND OF THE INVENTION

The present invention relates to an improved safety garment for protection of the wearer during emergency highway automobile repairs and in other situations where a high degree of wearer visibility is required.

Various types of garments having luminescent portions have been developed in the prior art for improving visibility of the wearer to oncoming motorists. However, these prior art garments each suffer from being either insufficiently noticeable, too complex in structure, or too bulky for compact storage. In addition, most older garments afford insufficient protection to the wearer's clothing against atmospheric moisture and soilage resulting from contact with automobile parts and tools.

It is a principal object of the present invention to provide a simple, one-piece safety garment adapted to cover the clothing of a wearer during emergency highway automobile repairs and in other situations where a high degree of wearer visibility is required.

It is a related object of the present invention to provide a garment constructed from a fabric impregnated with a lumuniscent orange dye that is highly visible to oncoming motorists.

Another object of the invention is to provide a one-piece garment having elastic bands on a hood and on cuffs of sleeves and pants, so that minimal effort is required to maintain the garment adjacent the body of a wearer even under adverse weather conditions.

Additional objects and advantages of the present invention will become apparent to persons skilled in the art from the following specification, taken in conjunction with the drawings.

BRIEF DESCRIPTION OF THE DRAWINGS

FIG. 1 is a front perspective view of a person wearing the safety garment for automobile repairs of the invention;

FIG. 2 is a rear elevational veiw thereof; and

FIG. 3 is a front perspective view of a person wearing the safety garment for automobile repairs of the invention while performing an emergency repair on his automobile.

BRIEF DESCRIPTION OF THE INVENTION

The safety garment 10 of the invention illustrated in FIGS. 1–3 is a one-piece garment covering all clothing of a wearer except his shoes. The garment 10 includes an upper or vest portion 11 having first and second lateral sides 12, 13 separated by a vertical slit 14. This slit 14 extends downwardly from an upper edge 15 of the vest portion to a lower terminus 16. The slit 14 is opened and closed by a vertical row of snaps or snap fastener means 17 having mating portions arranged along opposite sides of the slit 14.

First and second sleeves 20, 21 extend laterally outwardly of the respective first and second lateral sides 12, 13. Each sleeve 20, 21 defines an arm hole at its proximal extremity. The arm holes are both circumscribed by a permanent connection 22 with the vest portion 11. Distal ends of the sleeves 20, 21 include hand openings circumscribed by wrist cuffs 23. Each cuff 23 contains a narrow elastic band retaining the cuff 23 adjacent the wearer's wrist.

A lower or pants portion 25 includes first and second pant legs 26, 27 depending downwardly from respective first and second lateral sides 12, 13 of the vest portion 11. The pant legs 26, 27 each include a distal foot opening circumscribed by an ankle cuff 28. Each cuff 28 contains an elastic band or elastic means circumscribing the foot opening and retaining the cuff 28 adjacent the wearer's ankle.

A hood 30 is permanently attached to an upper edge 15 of the vest portion 11 and defines a frontal face opening bounded on its upper and lateral sides by a generally oval marginal edge portion 32. This edge portion 32 contains an elastic band or elastic means for retaining the hood in contact with the wearer's head even under gusty wind conditions.

The vest portion 11, sleeves 20, 21, pants portion 25, and hood 30 are constructed from a light-weight, 70 denier Nylon fabric that is rain-repellent. The fabric is impregnated with Rhodamine Red B dye (manufactured by Ciba-Geigy) which imparts a bright luminescent orange color. The garment 10 may be folded compactly for storage prior to use within a tool box, automobile glove compartment, or other convenient location.

FIG. 3 shows how the safety garment 10 of the invention is typically used. The garment prevents soilage of the wearer's clothing by grease, oil and rain, and its bright orange color is highly visible to approaching motorists for protection against accidental collisions. Additional uses of the garment of the invention are as a safety garment for bicycling and hunting, and as a garment to be worn over the body while hiking and jogging along highways and in isolated areas.

With the foregoing description of a preferred embodiment of the invention in mind, numerous improvements and modifications thereof will become readily apparent to persons skilled in the art without departing from the spirit and scope of the invention as set forth in the following claims.

What is claimed is:

1. A one-piece multi-purpose garment covering substantially all of the clothing of a wearer and comprising (a) a vest portion having first and second lateral sides separated by a vertical slit, (b) fastener means having mating portions arranged along opposite sides of said slit for opening and closure thereof, (c) first and second sleeves on respective said first and second lateral sides of the vest portion, each of said sleeves defining an arm hole at a proximal extremity thereof and including a permanent connection with an adjacent lateral side of the vest portion generally circumscribing said arm hole, each of said sleeves further defining a hand opening circumscribed by a wrist cuff at a distal extremity thereof, (d) first and second pant legs joined to respective said first and second lateral sides of the vest portion and depending downwardly therefrom, each of said pant legs defining a foot opening circumscribed by an ankle cuff at a lower extremity thereof, and (e) a hood permanently attached to an upper edge of said vest portion, and defining a forwardly facing opening bounded upwardly and laterally by a generally oval marginal edge portion; and wherein (1) said wrist cuff includes elastic means encircling said hand opening, said ankle cuff includes elastic means encircling said foot opening, and said marginal edge portion of the hood includes elastic means adapted to maintain said hood adjacent the head of a wearer irrespective of adverse wind conditions, each said elastic means comprising a narrow elastic band affixed to and encased within an adjacent inwardly folded edge portion of said garment, (2) said vest portion, said sleeves, said pant legs, and said hood comprise a rain-repellent fabric impregnated with a dye having a luminescent orange color, and (3) the fabric of said garment is 70 denier Nylon to facilitate compact folding for storage within an automobile glove compartment.

2. The garment of claim 1, wherein said dye comprises Rhodamine Red B.

* * * * *